United States Patent [19]

Komiya

[11] Patent Number: 4,901,792

[45] Date of Patent: Feb. 20, 1990

[54] PIPE ELEMENT FOR A HEAT EXCHANGER AND A HEAT EXCHANGER WITH THE PIPE ELEMENT

[75] Inventor: Jujiro Komiya, Fujisawa, Japan

[73] Assignee: Shinwa Sangyo Co., Ltd., Tokyo, Japan

[21] Appl. No.: 197,972

[22] Filed: May 24, 1988

[30] Foreign Application Priority Data

May 28, 1987 [JP] Japan ..... 62-079887

[51] Int. Cl.[4] ..... F28F 1/00

[52] U.S. Cl. ..... 165/150; 165/175

[58] Field of Search ..... 165/150, 175; 126/418, 126/420, 448

[56] References Cited

U.S. PATENT DOCUMENTS

| | | | |
|---|---|---|---|
| 1,325,596 | 12/1919 | Trosper | 126/448 X |
| 1,802,635 | 4/1931 | Eaton | 126/448 X |
| 1,837,449 | 12/1931 | Kunz | 126/448 |
| 2,257,524 | 9/1941 | De Bogory | 126/448 |
| 2,705,905 | 4/1955 | Rostock | 126/448 X |
| 2,954,213 | 9/1960 | Pellegrini | 165/71 |
| 4,062,348 | 12/1977 | Morrison | 126/448 X |
| 4,122,830 | 10/1978 | Hapgood | 126/448 X |

*Primary Examiner*—Martin P. Schwadron
*Assistant Examiner*—Allen J. Flanigan
*Attorney, Agent, or Firm*—Oblon, Spivak, McClelland, Maier & Neustadt

[57] ABSTRACT

A pipe element for a heat exchanger which comprises at least one bent portion and at least two linear portions connected to the bent portion wherein an angle formed by the adjacent two linear portion is in a range of from about 30′ to 3°.

5 Claims, 3 Drawing Sheets

PIPE ELEMENT FOR A HEAT EXCHANGER AND A HEAT EXCHANGER WITH THE PIPE ELEMENT

BACKGROUND OF THE INVENTION

1. Field of the Invention

The present invention relates to a pipe element used for a heat exchanger such as a gas-liquid or a liquid-liquid non-contact type heat exchanger and a heat exchanger employing such pipe elements.

2. Discussion of Background

FIG. 6 shows the structure of a conventional heat-exchanging pipe. The pipe is formed in a zig-zag form having a plurality of U-shaped bent portions and a plurality of linear portions connected to both sides of the U-shaped bent portions so that the linear portions extend in parallel to each other.

In the conventional heat exchanger, when the zig-zagged pipe is to be installed in the horizontal direction, it is necessary to give some difference in height between the inlet and outlet of the zig-zagged pipe so that liquid in the pipe can be easily drained. Such construction, however, places each of the linear portions of the pipe horizontally with respect to the ground on which the heat exchanger is set. Accordingly, it is unavoidable that some amount of the liquid remains in it even though the liquid in the zig-zagged pipe is to be drained.

Further, it sometimes happens that the zig-zagged pipe is deformed by an external force. In this case, a substantial amount of liquid remains in the deformed linear portion, which may cause the damage to the pipe when the remaining water is frozen in winter or when the pipe is at a cold place.

SUMMARY OF THE INVENTION

It is an object of the present invention to provide a pipe element for a heat exchanger and a heat exchanger with such pipe elements which is free from the risk of the damage of the pipe element for the heat exchanger caused by the freezing of water in the pipe due to remaining of the liquid in the pipe.

The foregoing and the other objects of the present invention have been attained by providing a pipe element for a heat exchanger which comprises at least one bent portion and at least two linear portions connected to the bent portion wherein an angle formed by the adjacent two linear portions is in a range of from about 30′ to 3°.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Preferred embodiments of the present invention will be described with reference to drawings.

Figure 1:
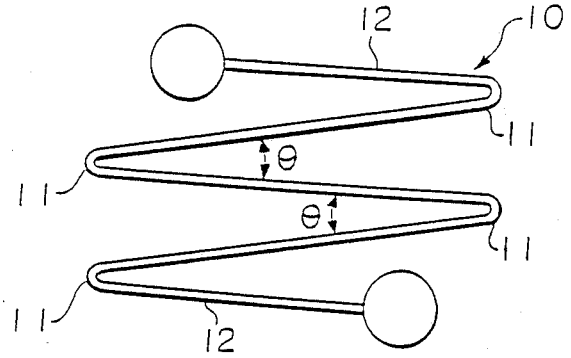
FIG. 1 is a front view of an embodiment of the pipe element for a heat exchanger according to the present invention.

In FIG. 1, a reference numeral 10 designates a pipe element for a heat exchanger. The pipe element comprises at least one unit consisting of a bent portion 11 and two linear portions 12 connected to both ends of the bent portion 11. In the embodiment shown in FIG. 1, a zig-zagged pipe is composed of four units of the pipe element 10. The zig-zagged pipe may be formed by bending a single pipe material into a zig-zagged form or may be formed by joining four bent portions 11 and five linear portions 12. The bent portion is in a substantially U-shape having a round corner, or may have a V-shape. The pipe element is preferably made of stainless steel, or a titanium alloy. However, the material of the pipe element to be used is not limited as far as it is suitable for the heat exchanger.

In the pipe unit 10, the two linear portions 12 connected to the single bent portion 11 are not in parallel to each other, but extend at some degree of angle $\theta$. The angle defined by the two linear portions 12 connected to the bent portion 11 is in a range of 30′–3°, preferably about 37′–50′. When the angle defined by the adjacent two linear portions is greater than 3°, the surface area for heat exchanging in the heat exchanger is reduced. On the other hand, when the angle is smaller than 30′, draining effect becomes poor and a conspicuous effect can not be obtained in comparison with the conventional zig-zag pipe.

Figure 6:
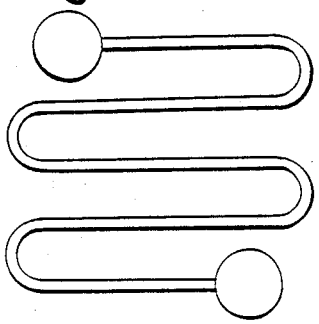
FIG. 6 is a front view showing a conventional pipe element for a heat exchanger.

For the bent portion 11, a value x is determined to be 0.1–2 where R (the radius of curvature of the axial line of the pipe at the bent portion)=d (the diameter of the pipe) multiplied by x. Generally it is desirable that the radius of curvature of the axial line R is smaller than that in the conventional zig-zag pipe having parallel linear portions 12 (FIG. 6).

Figure 2:
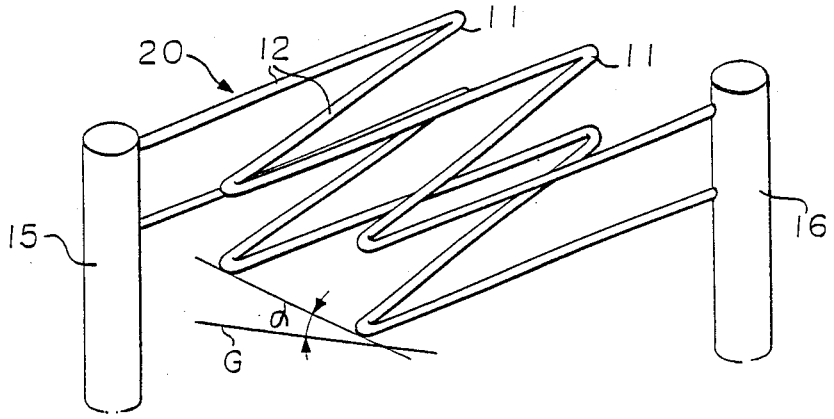
FIG. 2 is a perspective view of a part of the heat exchanger according to the present invention.

In the following, description will be made how a heat exchanger 20 is assembled by using the zig-zag pipes with reference to FIG. 2.

A plurality of the zig-zag pipes having the same shape, i.e. the same numbers of the bent portions 11, the linear portions 12 and the same size, are prepared. The zig-zag pipes are arranged in a multi-stage with predetermined distances therebetween in such a manner that planes each including the zig-zag line are inclined at an angle $\theta$ of about 2°–3° from the horizontal line G so that the inlet side of each of the zig-zag pipes is higher than the outlet side. Each of the inlet side of the zig-zag pipes is commonly connected to a first header 15 for supplying liquid to be cooled. Each of the outlet side of the zig-zag pipes are commonly connected to a second header 16 for discharging the liquid.

Figure 3:
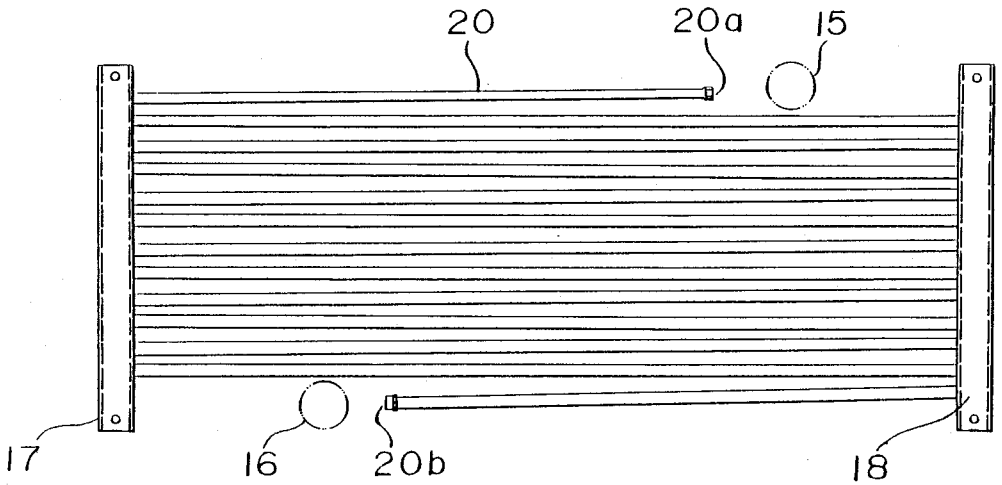
FIG. 3 is a front view showing in more detail of an embodiment of the heat exchanger of the present invention.
Figure 5:
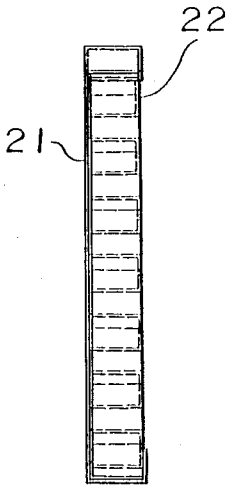
FIG. 5 is a side view of the supporting frame.

FIG. 3 shows the heat exchanger of the present invention in more detail. The bent portions at both sides of the heat exchanger 20 are supported by channel-like side plates 17, 18 through spacers (not shown). The inlet port **20*a* of the heat exchanger 20 is connected to a liquid supplying side header 15 and the outlet port 20*b* is connected to a liquid discharge side header 16**.

Figure 4:
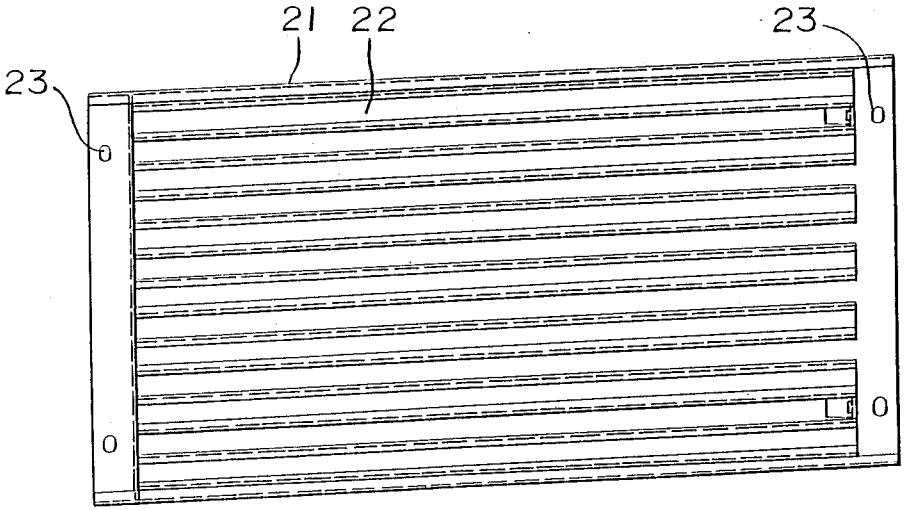
FIG. 4 is a front view of an one of supporting frames for supporting the heat exchanger as shown in FIG. 3 in a slanted state.

FIG. 4 shows an embodiment of one of supporting frames 21 which are placed at both sides of the heat exchanger 20 to support it by means of slide rails 22 engaged with the channel-like side plates 17, 18.

Each of the supporting frames 21 is in a generally diamond-like shape with the lower long side slanted at an angle of from about 2° to about 3° with respect to the horizontal plane. In this embodiment, the angle of the supporting frames is determined to be 2.39°.

A plurality of channel-like slide rails 22 are attached to one surface of the frame in parallel to the lower long side with spaces therebetween. Each of the supporting frames 21 has four fitting holes 23 by which the supporting frames 21 are fixed to a casing (not shown) so as to oppose to each other.

In assembling the heat exchanger 20, the channel-like side plates 17, 18 are inserted into the channel-like slide rails 22 from one side.

Accordingly, the plane including the zig-zag line of the heat exchanger 20 is inclined from the inlet port side to the outlet port side with respect to the horizontal plane, whereby the liquid is completely discharged when the liquid is to be drained.

As described above, in accordance with the present invention, the linear portions of the zig-zag pipes are always in a slanted state to thereby avoid the staying of the liquid therein and drainage of the liquid is easy. Accordingly, there is no possibility of damage in the pipes due to freezing, the maintenance of the heat exchanger can be easily performed and the life time of the apparatus can be prolonged.

Obviously, numerous modifications and variations of the present invention are possible in light of the above teachings. It is therefore to be understood that within the scope of the appended claims, the invention may be practiced otherwise than as specifically described herein.

What is claimed is:

1. A heat exchanger which comprises a first header for supplying a liquid to be cooled, a second header for discharging the cooled liquid and a plurality of substantially horizontal pipe elements communicatively connected between said first and second headers in juxtaposition, each of said pipe elements comprising at least one bent portion and at least two linear portions connected to said bent portion, respective ones of said linear portions being connected to said first and second headers, wherein an angle formed by two adjacent ones of said linear portions is in a range of from about 30′ to 3° and wherein said linear portions are disposed in a plane inclined at an angle of 2°–3° with respect to a horizontal plane such that said linear portion connected to said first header is higher than said linear portion connected to said second header, whereby a cooling liquid will drain from said pipe elements to said second header.

2. The heat exchanger according to claim 1, wherein each said pipe element has a zig-zag configuration formed by a plurality of said bent portions and more than two linear portions, wherein said angle between any two of said linear portions is the same.

3. The heat exchanger according to claim 1, wherein said angle between two linear portions is in the range of from 37′ to 50′.

4. The heat exchanger according to claim 1, wherein said pipe element is made of a single pipe.

5. The heat exchanger according to claim 1, wherein said pipe element comprises at least one bent joint and at least two linear pipes.

* * * * *